US006168514B1

(12) United States Patent
Weston

(10) Patent No.: US 6,168,514 B1
(45) Date of Patent: Jan. 2, 2001

(54) APPARATUS FOR EVACUATING SEWER GAS FROM A SEWER SYSTEM

(75) Inventor: Willie R Weston, Gadsden, SC (US)

(73) Assignees: Arletha Heatley; Marcus Harris; Shanta Harris; Steven Harris, all of Gadsden, SC (US)

( * ) Notice: Under 35 U.S.C. 154(b), the term of this patent shall be extended for 0 days.

(21) Appl. No.: 09/399,409

(22) Filed: Sep. 20, 1999

Related U.S. Application Data

(60) Provisional application No. 60/101,543, filed on Sep. 23, 1998.

(51) Int. Cl.[7] ..... B65D 90/22
(52) U.S. Cl. ..... 454/48
(58) Field of Search ..... 454/48, 49, 341, 454/346, 354

(56) References Cited

U.S. PATENT DOCUMENTS 3,093,056 * 6/1963 Rosenfeld ..... 454/48
3,610,524 * 10/1971 Wallen ..... 454/48
4,285,269 * 8/1981 pelsue et al. ..... 454/48
4,662,268 * 5/1987 Beavers ..... 454/48

FOREIGN PATENT DOCUMENTS

39601 * 1/1986 (GB) ..... 454/48

* cited by examiner

*Primary Examiner*—Harold Joyce
*Assistant Examiner*—Derek S. Boles
(74) *Attorney, Agent, or Firm*—Michael E. Wever; Michael A. Mann; Nexsen Pruet Jacobs and Pollard

(57) ABSTRACT

An apparatus for evacuating sewer gas from a city sewer system comprises a frame that can be inserted into a manhole and supported by the surface surrounding the manhole, a gasoline engine carried by the frame, and a fan turned by the engine shaft so that it draws air upwards from the sewer through ventholes formed in the frame.

7 Claims, 2 Drawing Sheets

APPARATUS FOR EVACUATING SEWER GAS FROM A SEWER SYSTEM

PRIORITY CLAIM

This application claims the benefit of U.S. Provisional Application No. 60/101,543, filed on Sep. 23, 1998, which is hereby incorporated by reference.

FIELD OF THE INVENTION

The present invention relates to the repair and serving of sewer systems. In particular, the present invention relates to an apparatus for evacuating sewer gas from a city sewer.

BACKGROUND OF THE INVENTION

In an urban area, under the streets, sewer systems are established to collect rain water and street debris and to direct them to collection points where it can be filtered, treated and the water released into the environment. Inevitably, organic debris such as leaves and sticks will be washed into the sewer system and may become trapped. This organic matter will decay, inevitably producing methane gas, or "sewer" gas.

City sewer systems can collect sewer gas which can pose a hazard to workers whose job it is to enter the sewer for servicing, inspection and repair. Devices exist to detect sewer gas and, when properly used, will prevent workers from accidentally exposing themselves to the gas. However, the gas remains unless it is removed. The fact that the gas was trapped in the first place suggests that allowing the gas to dissipate naturally may not be practical.

Therefore, there is a need for a device that removes sewer gas from city sewers.

SUMMARY OF THE INVENTION

According to its major aspects and broadly stated, the present invention is an apparatus for evacuating sewer gas from a sewer system. The apparatus comprises a generally cylindrical frame that holds a small gasoline engine with a shaft that carries a fan. The frame fits into the top of a manhole and rests on the surrounding surface. Once the engine is started, the fan will draw air from within the sewer system through the frame and ventilate the sewer gas to the atmosphere where it can dissipate harmlessly.

A feature of the present invention is the use of a gasoline engine to operate the venting fan. The gasoline engine requires no connection to electrical power, starts quickly and has the power to pull air through the sewer system.

Another feature of the present invention is the frame that is dimensioned to fit standard manholes, after the manhole cover is removed. Not only is this a convenient and secure location for the apparatus but it turns the manhole into a chimney for efficient ventilation of the sewer system. Furthermore, while the present invention is in position and evacuating sewer gas, the manhole cannot be entered inadvertently by a worker before the sewer has been re-checked for sewer gas.

Still another feature of the present invention is the use of a simple upward-pulling fan to evacuate the sewer. The fan creates a negative pressure within the sewer than will affect every portion of it and cause the movement of the sewer gas from it, rather than wait for dissipation of the sewer gas.

Other features and advantages of the present invention will be apparent to those skilled in the art from a careful reading of the Detailed Description of a Preferred Embodiment presented below and accompanied by the drawings.

DETAILED DESCRIPTION OF A PREFERRED EMBODIMENT

Figure 1:
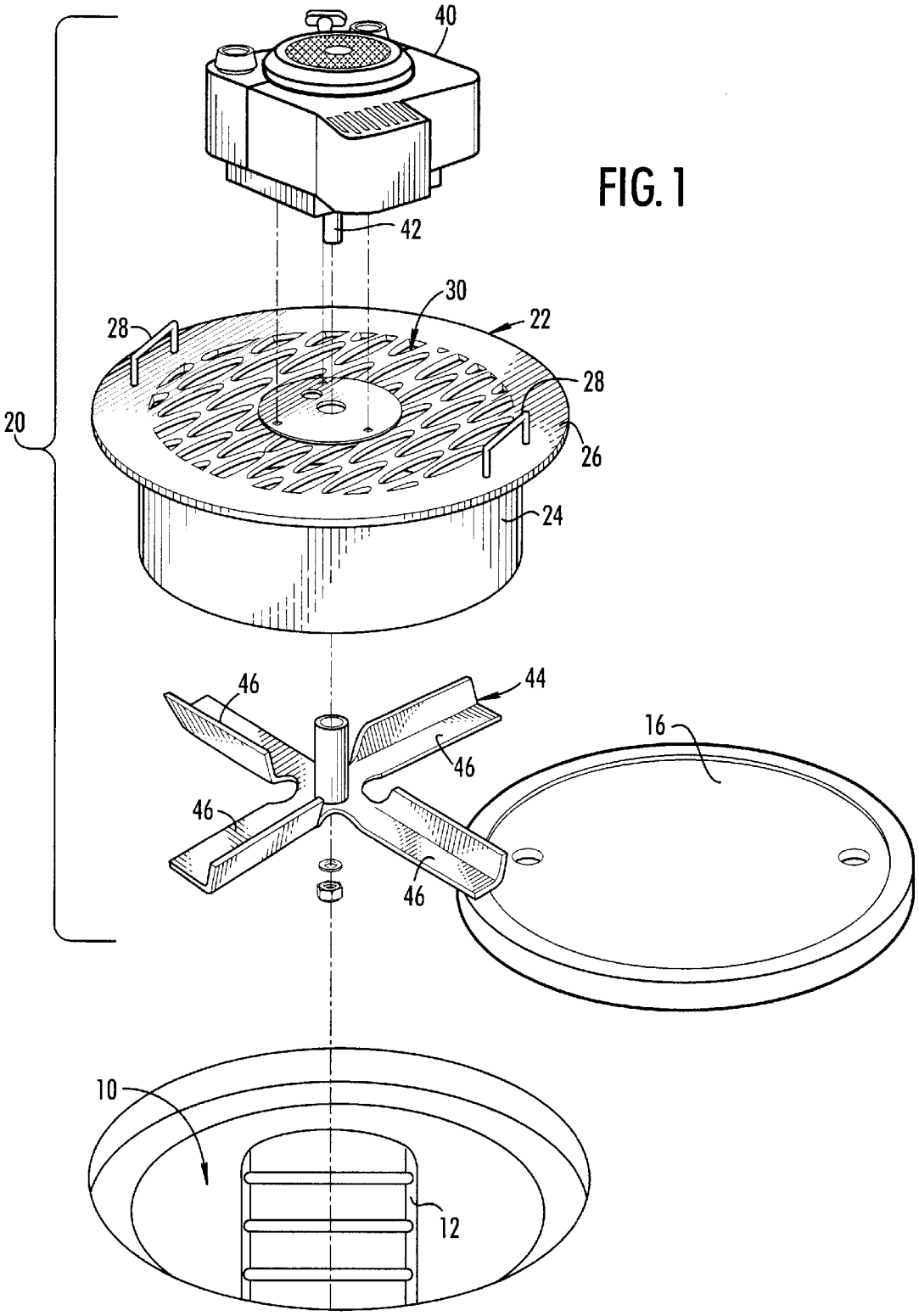
FIG. 1 is an exploded perspective view of an apparatus for evacuating sewer gas from a sewer system according to a preferred embodiment of the present invention.
Figure 2:
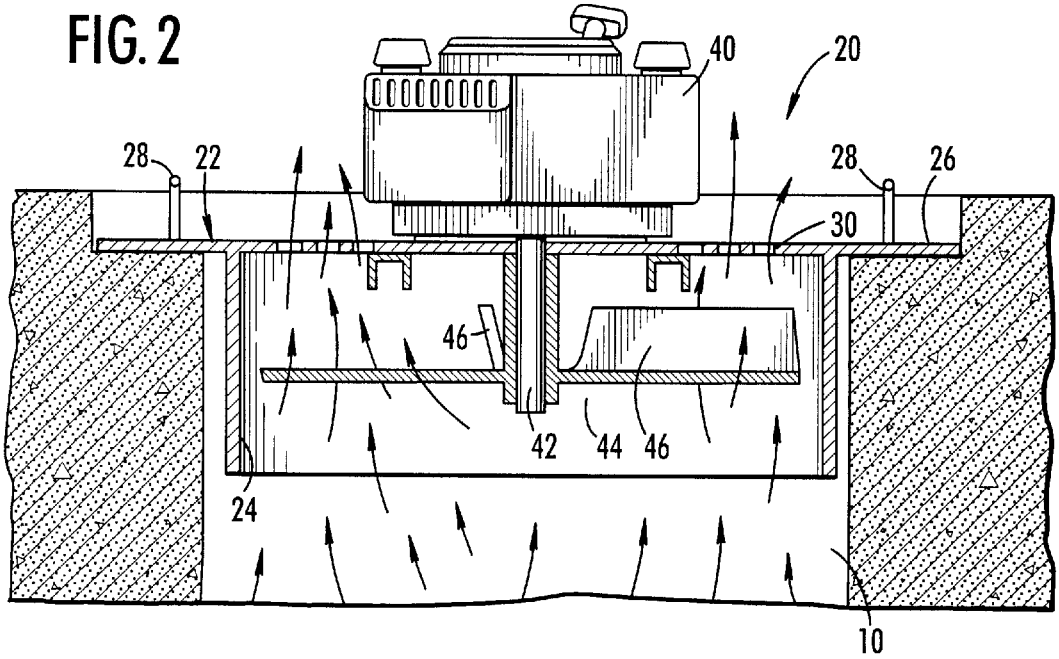
FIG. 2 is a side cross sectional view of the apparatus for evacuating sewer gas, according to a preferred embodiment of the present invention.

Referring now to the figures, the present invention is an apparatus for evacuating sewer gas from a sewer line in a city sewer system. A city sewer system will have manholes spaced at intervals along its length. A manhole, generally indicated with reference number 10, provides access to the sewer system for a worker who will climb down a ladder 12 to the sewer. When manhole 10 is to be accessed, a manhole cover 16 will be removed and set to the side.

As a precaution, a meter (not shown) will be lowered to test for the presence of sewer gas. If no sewer gas is present, the worker will descend ladder 16 to sewer. If gas is present, the present apparatus 20 will be used. The manhole, the manhole cover and the meter are not part of the present apparatus.

Apparatus 20 comprises a frame 22 that is generally cylindrical and dimensioned to fit into manhole 10 and rest on the surrounding surface 18. Preferably, frame 22 has a skirt 24 and an integral flange 26. Skirt 24 has an outside diameter just smaller than the inside diameter of manhole 10 and flange 26 has an outside diameter larger than the diameter of manhole 10 so that flange 26 rests on surface 18. Frame 22 has two lifting handles 28 and a plurality of ventholes 30 in the top surface of frame 22.

A gasoline engine 40 is mounted to frame 22. Engine 40 has a shaft 42 to which is attached a fan 44 with plural blades 46. Fan 44 is secured to shaft 42 by a nut and washer. Blades 46 are curved so that, when engine 40 rotates shaft 42, air and any sewer gas are drawn up through skirt 24 of frame 22 through ventholes 30 and out into the atmosphere where it can dissipate.

After apparatus is operated for a period of time, the sewer is re-checked for the presence of gas. Once the gas has been reduced to minimal concentrations, apparatus 20 can be lifted free of manhole 10 and workers can gain access.

The power required for engine 40 and the air flow capability of fan 44 will depend to some extent on the configuration of the sewer. If manholes are placed at each intersection, then lifting at least one adjacent manhole cover will allow fresh air from the street to be sucked into that manhole when drawn by the present invention at the next manhole. Shorter segments of sewer piping reduce the power requirements from that of longer segments. The interior volume of piping also affects the power requirements: the larger the piping, the more power is needed to move the air in that segment. The weight, curvature and speed of blades 46 will also affect power requirements, as well as the speed desired for the evacuation. However, for most applications an engine of a few horsepower will be suitable.

Engine 40 is preferably a gasoline engine of the pull-to-start variety. It is mounted to frame 22 preferably near the center of frame 22 so that exhaust fumes from the engine are carried upwards by the air and sewer gas being vented from the sewer. Mounting engine 40 in the center also allows blades 46 to be as large as possible for greater air pulling power and for a more direct coupling of shaft 42 to fan 44.

It will be apparent to those skilled in the art that many changes and substitutions can be made to the preferred embodiment herein described without departing from the spirit and scope of the present invention as defined by the appended claims.

What is claimed is:

1. An apparatus for evacuating sewer gas from a sewer line, said sewer line connected to a manhole, said apparatus comprising:

a frame having a flange and a skirt, said flange having a larger diameter than a manhole of a sewer line and said skirt having a smaller diameter than a manhole, said frame having ventholes formed therein;

an engine mounted to said frame; and a fan carried by said frame within said skirt and in operational connection with said engine, said engine cause said fan to draw air through said ventholes in said frame from said sewer line.

2. The apparatus as recited in claim 1, wherein said engine is a gasoline powered engine.

3. The apparatus as recited in claim 1, wherein said frame has a lifting handle.

4. The apparatus as recited in claim 1, wherein said engine is mounted on top of said frame.

5. The apparatus as recited in claim 2, wherein said frame has a lifting handle.

6. The apparatus as recited in claim 3, wherein said frame has a lifting handle.

7. The apparatus as recited in claim 2, wherein said engine is mounted on top of said frame.

* * * * *

Disclaimer 6,168,514—Willie R. Weston, Gadsden, SC. APPARATUS FOR EVACUATING SEWER GAS FROM A SEWER SYSTEM. Patent dated January 2, 2001. Disclaimer filed July 2, 2001, by the inventor, Willie R. Weston.

Hereby enters this disclaimer to the remaining term of said patent.

*(Official Gazette, November 13, 2001)*